US008122557B2

(12) United States Patent
Arnold et al.

(10) Patent No.: US 8,122,557 B2
(45) Date of Patent: Feb. 28, 2012

(54) BROOM BODY

(75) Inventors: Peter L. Arnold, Heppenheim (DE); Ralf Jürgens, Hemsbach (DE)

(73) Assignee: Carl Freudenberg KG, Weinheim (DE)

( * ) Notice: Subject to any disclaimer, the term of this patent is extended or adjusted under 35 U.S.C. 154(b) by 1070 days.

(21) Appl. No.: 11/910,145

(22) PCT Filed: Mar. 31, 2006

(86) PCT No.: PCT/EP2006/002926

§ 371 (c)(1),
(2), (4) Date: Jan. 25, 2008

(87) PCT Pub. No.: WO2006/122607

PCT Pub. Date: Nov. 23, 2006

(65) Prior Publication Data

US 2008/0189890 A1 Aug. 14, 2008

(30) Foreign Application Priority Data

May 19, 2005 (DE) ..... 10 2005 022 948

(51) Int. Cl.
*A47L 13/12* (2006.01)
*A47L 13/11* (2006.01)

(52) U.S. Cl. ..... 15/117; 15/114; 15/146; 15/176.1; 15/183

(58) Field of Classification Search ..... 15/117, 15/114, 146, 160, 176.1, 183
See application file for complete search history.

(56) References Cited

U.S. PATENT DOCUMENTS

| | | | | |
|---|---|---|---|---|
| 2,893,044 | A * | 7/1959 | Kurose | 15/322 |
| 3,434,176 | A * | 3/1969 | Cazet | 15/177 |
| 3,619,845 | A * | 11/1971 | Partridge | 15/117 |
| 6,925,673 | B2 * | 8/2005 | Sartori | 15/191.1 |
| 2004/0250365 | A1 | 12/2004 | Anderson et al. | |
| 2005/0044648 | A1 * | 3/2005 | Jones et al. | 15/172 |

FOREIGN PATENT DOCUMENTS

| | | | |
|---|---|---|---|
| DE | 2 119 793 | A | 11/1972 |
| DE | 31 36 401 | C2 | 3/1983 |
| DE | 3136401 | C2 | 3/1983 |
| DE | 38 34 301 | A1 | 4/1990 |
| DE | 3834301 | A1 | 4/1990 |
| DE | 20215572 | U1 | 4/2003 |
| DE | 202 15 572 | U | 5/2003 |
| DE | 10214870 | A1 * | 10/2003 |
| DE | 103 32 405 | A1 | 2/2005 |
| DE | 10332405 | A1 * | 2/2005 |
| GB | 1405845 | A | 9/1975 |
| JP | 3084946 | U | 12/2001 |
| JP | 2002-017616 | A2 | 1/2002 |

* cited by examiner

*Primary Examiner* — Shay Karls
(74) *Attorney, Agent, or Firm* — Leydig, Voit & Mayer, Ltd.

(57) ABSTRACT

The invention relates to a broom body (1) having, on its underside facing the surface to be cleaned, at least two cleaning bodies (3, 4) made of different materials. One cleaning body (3) is forted by a foam material body (5), which is non-positively and/or positively joined to the broom body (1). This foam material body (1) can be inserted into the broom body (1) in a manner that is perpendicular to the longitudinal axis (6) of the broom body (1), and the foam material body (5) has at least one fastening means (7) for positively fastening it to the broom body.

5 Claims, 12 Drawing Sheets

BROOM BODY

TECHNICAL FIELD

The invention relates to a broom body having, on its underside facing the surface to be cleaned, at least two cleaning bodies made of different materials, where one cleaning body is formed by a foam material body which is non-positively and/or positively joined to the broom body.

STATE OF THE ART

Such broom bodies are known from DE 103 32 405 A1. The previously known broom body presents a foam material body and a carrier body provided with bristles. Here, the primary purpose of the bristles is the detachment and removal of firmly adhering coarse debris, and that of the foam material body is the removal of fine debris particles so as to prevent the generation of dust. The combination of the two materials allows the possibility of removing different types of debris with a single broom body. The foam material body here presents, because of the material and the full-surface design, a higher friction and it is subject to greater wear. Therefore, the foam material body is positively fastened to the broom body in such a way that allows its easy replacement.

In the previously known broom body, the fastening of the foam material body is carried out by means of a dovetail joint. However, the undercutting makes the joint expensive to manufacture.

DESCRIPTION OF THE INVENTION

The invention is based on the problem of providing a broom body which can be manufactured in a simple manner and which presents easily exchangeable foam material bodies.

In a first solution, the foam material body can be introduced into the broom body, perpendicularly to the longitudinal axis of the broom body and the foam material body presents at least one fastening means for positively fastening it to the broom body. With a perpendicular direction of introduction, the joint for fixing the foam material body can be designed without undercuts. For example, the joint can be formed with a rectangular or V-shaped socket, which can also be manufactured particularly advantageously in an injection molding process. During the cleaning process, the socket transmits the forces and torques into the broom body. To fasten the foam material body in a manner that does not allow detachment, the foam material body presents at least one fastening means by which the foam material body can be fixed on the broom body.

In an additional solution, the foam material body presents a fastening means which is designed as a dovetail pin, and which can be introduced into a correspondingly shaped dovetail socket, where the dovetail socket is interrupted in sections. The dovetail socket is designed here so that it is raised and it extends above the surface of the broom body. The interruptions and dovetail socket sections are preferably placed opposite each other. If this arrangement is used, the manufacture is simplified, particularly the manufacture of the broom body by injection molding, because the interruptions allow the easy introduction of the tool for forming the dovetail socket sections. In this embodiment, the introduction of the foam material body occurs parallel to the longitudinal axis of the broom body. To fix the foam material body, the dovetail pins can present an elevation or a recess at one end, which can be engaged to a recess or an elevation arranged in a dovetail socket section. This fixation allows a secure fastening and can be easily manufactured.

The fastening means can be formed by a headless pin, which can be engaged in an opening of the broom body and can be fixed by means of a screw. Headless pins are available as prefabricated semi-finished parts. A screw connection is a connection that is simple to manufacture and secure. The operation is simple. In this embodiment, profiles for torque transmission can be omitted, allowing a particularly simple manufacture of the broom body.

The fastening means can be formed by a pin which is provided with bulges, where the pin can be engaged into a recess of the broom body where the broom body presents a longitudinal slit into which locking element can be introduced, and where the locking element can be engaged in the undercut formed by the bulge. Here, only two manual movements are required for fastening the foam material body: on the one hand, the introduction of the foam material body and on the other, the latching by means of the locking element. Because of the engagement, it is easy to check the connection. The locking element presents a simple structure and can be manufactured simply and cost effectively.

The fastening means can be formed by at least one strap, which can be introduced through an opening of the broom body, where the strap presents a film hinge and a snap hinge closure element. The strap here is formed of the same material as, and as a single piece with, the foam material body or a carrier body arranged on the foam material body. As a result, the number of parts is reduced. Because of the snap hinge closure element, the seating of the connection can be easily checked, because the engagement can be heard and sensed when it occurs.

The fastening means can be formed by an essentially rectangular profile, which can be engaged into a correspondingly shaped matching profile of the broom body, as well as by a snap hinge closure element which can be engaged into a recess of the broom body. In this embodiment as well, there is a reduction in the number of parts. Moreover, the profiles can be manufactured simply and cost-effectively.

The foam material body can present a carrier body on which the fastening means is arranged. Here, the carrier body can be manufactured from a more stable and more rigid material, particularly a material that is suitable for injection molding. The fastening means is then arranged in a stable way on the carrier body. In this embodiment, the strap is formed from the same material as, and as a single piece with, the carrier body.

The carrier body can partially enclose the foam material body. Here, the force transmission from the foam material to the carrier body is improved, and the load is distributed over a larger surface area. The foam material body is guided securely.

The carrier body can comprise two parts which are non-positively and/or positively joined. A two-part carrier body is easier to manufacture. The two parts can be non-positively and/or positively joined, whereby material-to-material connections are possible. Positive and non-positive connections allow a simple replacement of the foam material body, and the carrier material can be reused.

One part can present protrusions which can be inserted into recesses of the foam material body. As a result, the foam material body is positively fixed in the carrier body in a manner that prevents detachment.

At least one part can present tooth-shaped elevations. The tooth-shaped elevations that dig into the foam material body form a fixation. The tooth-shaped elevations can be provided in addition to the protrusions on the carrier body.

Both parts can present tooth-shaped elevations, which are arranged so that the parts mutually engage. Here, the foam material body is fixed between the teeth, and as a result the connection is even more stable.

BRIEF DESCRIPTION OF THE DRAWING

Several embodiments are shown below with reference to the figures. The figures show, each schematically.

EMBODIMENT OF THE INVENTION

Figure 1:
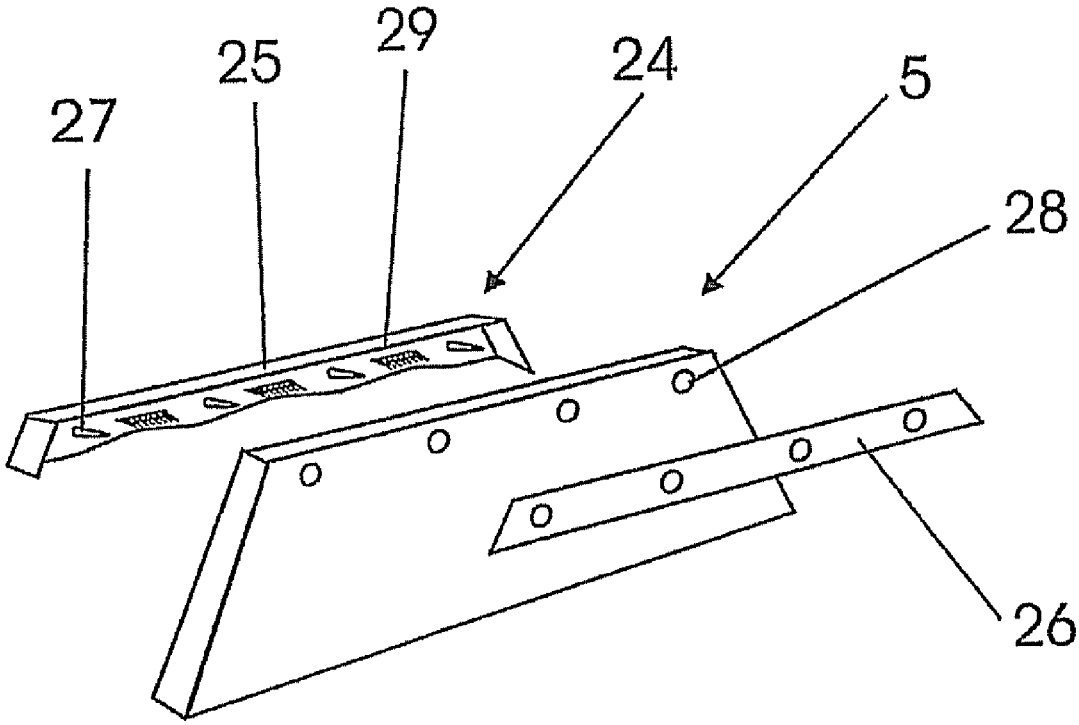
FIG. 1 a foam material body with carrier body.

The figures show a broom body 1, which presents, on its bottom side 2 facing the surface to be cleaned, at least two cleaning bodies 3, 4 made of different materials. One cleaning body 3 is formed by a foam material body 5, and the other cleaning body 4 is formed by bristles. The additional cleaning body 4 is non-positively and/or positively connected to the broom body 1, because the wear of the bristles is negligible. The foam material body 5 is non-positively and/or positively joined to the broom body 1. For positive fastening, the foam material body 5 presents at least one fastening means 7. The foam material body 5 presents a carrier body 24 on which the fastening means 7 is arranged.

FIG. 1 shows a foam material body 5 for fastening to a broom body 1. The foam material body 5 presents a carrier body 24, which partially encloses the foam material body 5. The carrier body 24 covers the top side which faces the broom body 1, and, in each case, it covers a section of the side surfaces of the foam material body 5. The carrier body 24 consists of two parts 25, 26. One part here presents protrusions 27, which can be inserted into the recesses 28 of the foam material body. The protrusions 27 are formed simultaneously as clipping elements for non-positively and positively fastening the two parts 25, 26. One part 25 presents tooth-shaped elevations 29.

Figure 2:
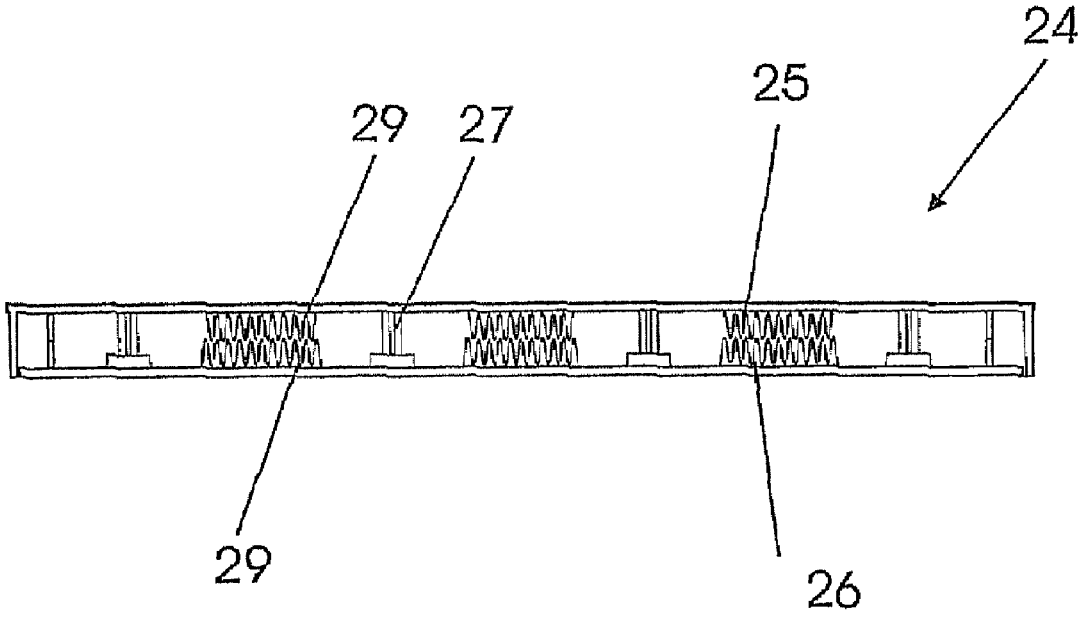
FIG. 2 the foam material body in cross section.

FIG. 2 shows the carrier body according to FIG. 1 in cross section. In this embodiment, both parts 25, 26 present tooth-shaped elevations 29, which are arranged to engage mutually, and which clamp the foam material body 5 when used as intended.

Figure 3:
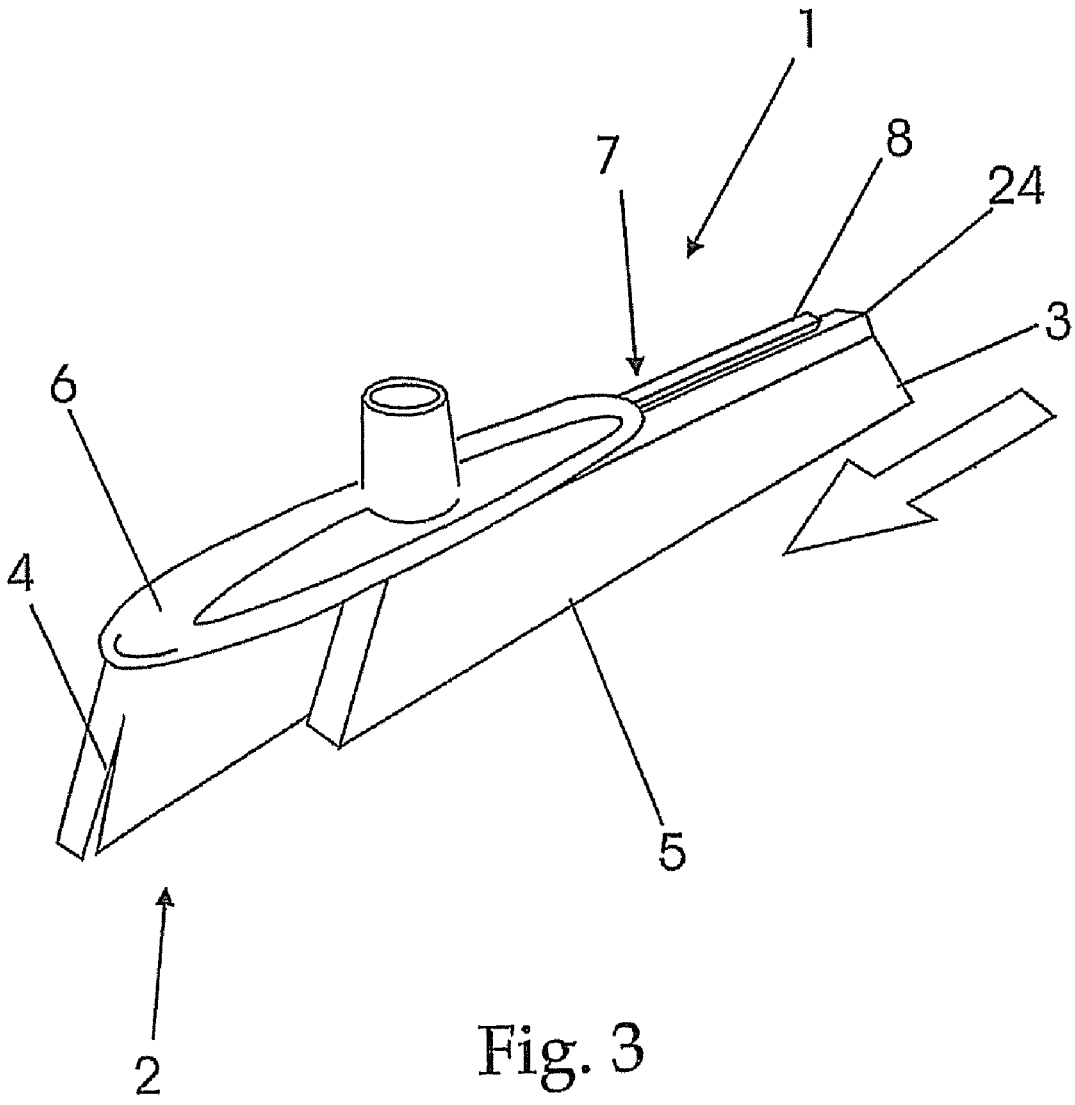
FIG. 3 a broom body with a fastening means configured as a dovetail joint.

FIG. 3 shows a broom body 1 whose fastening means 7 is formed by a dovetail pin 8. The dovetail pin 8 can be inserted into a correspondingly shaped dovetail socket 9 of the broom body 1.

Figure 4:
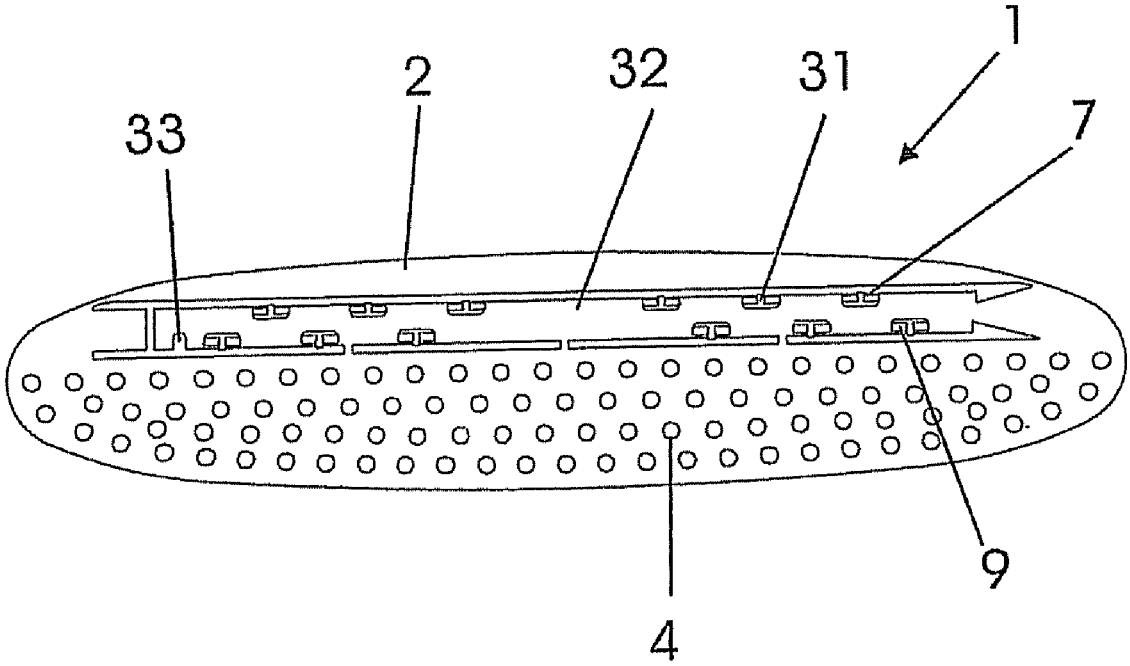
FIG. 4 the broom body according to FIG. 3 in bottom view.

FIG. 4 shows the broom body 1 according to FIG. 3 in the bottom view. FIG. 3 shows the dovetail socket 9 which is interrupted in sections. Here, the interruptions 32 and the dovetail socket sections 31 are arranged opposite each other, where the interruptions 32 are longer than the dovetail socket sections 31. In this embodiment, the insertion of the foam material body 5 occurs parallel to the longitudinal axis 6 of the broom body 1. For the fixation of the foam material body 5, a dovetail socket section 31 presents an elevation 33.

Figure 5:
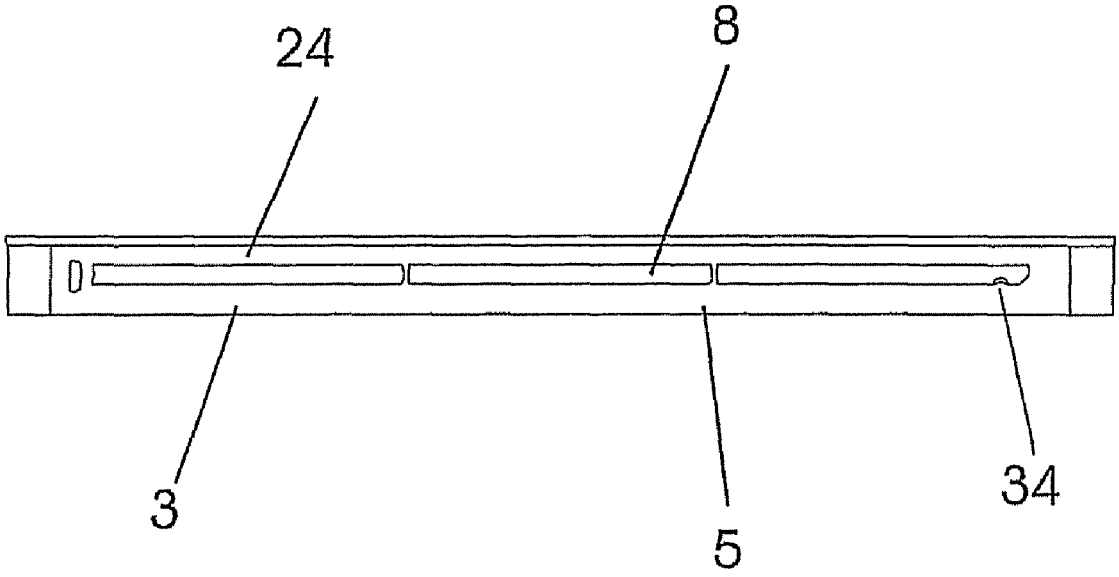
FIG. 5 a foam material body with dovetail pin.

FIG. 5 shows the foam material body 5 with the fastened carrier body 24. The dovetail pin 8, which presents a recess 34 at one end, is made of the same material as, and forms a single piece with, the carrier body 24. For the fixation, the elevation 33 of the broom body 1 engages with the recess 34.

Figure 6:
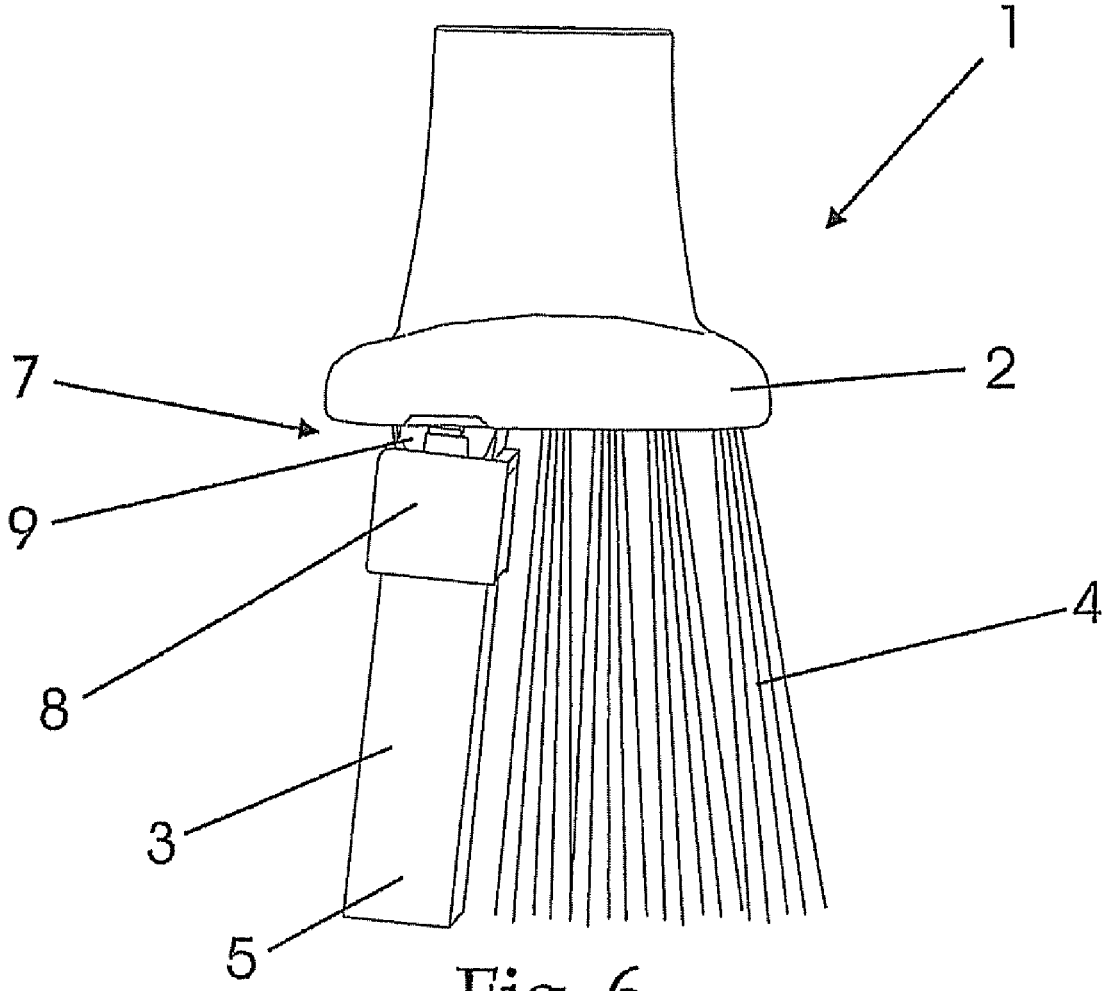
FIG. 6 the broom body according to FIG. 3 in side view.

FIG. 6 shows the broom body according to FIG. 3 in a side view.

The foam material body 5 of the following figures can be inserted into the broom body 1 perpendicularly to the longitudinal axis 6 of the broom body 1. For positively fastening the foam material body 5 to the broom body 1, each foam material body presents at least one fastening means 7.

Figure 7:
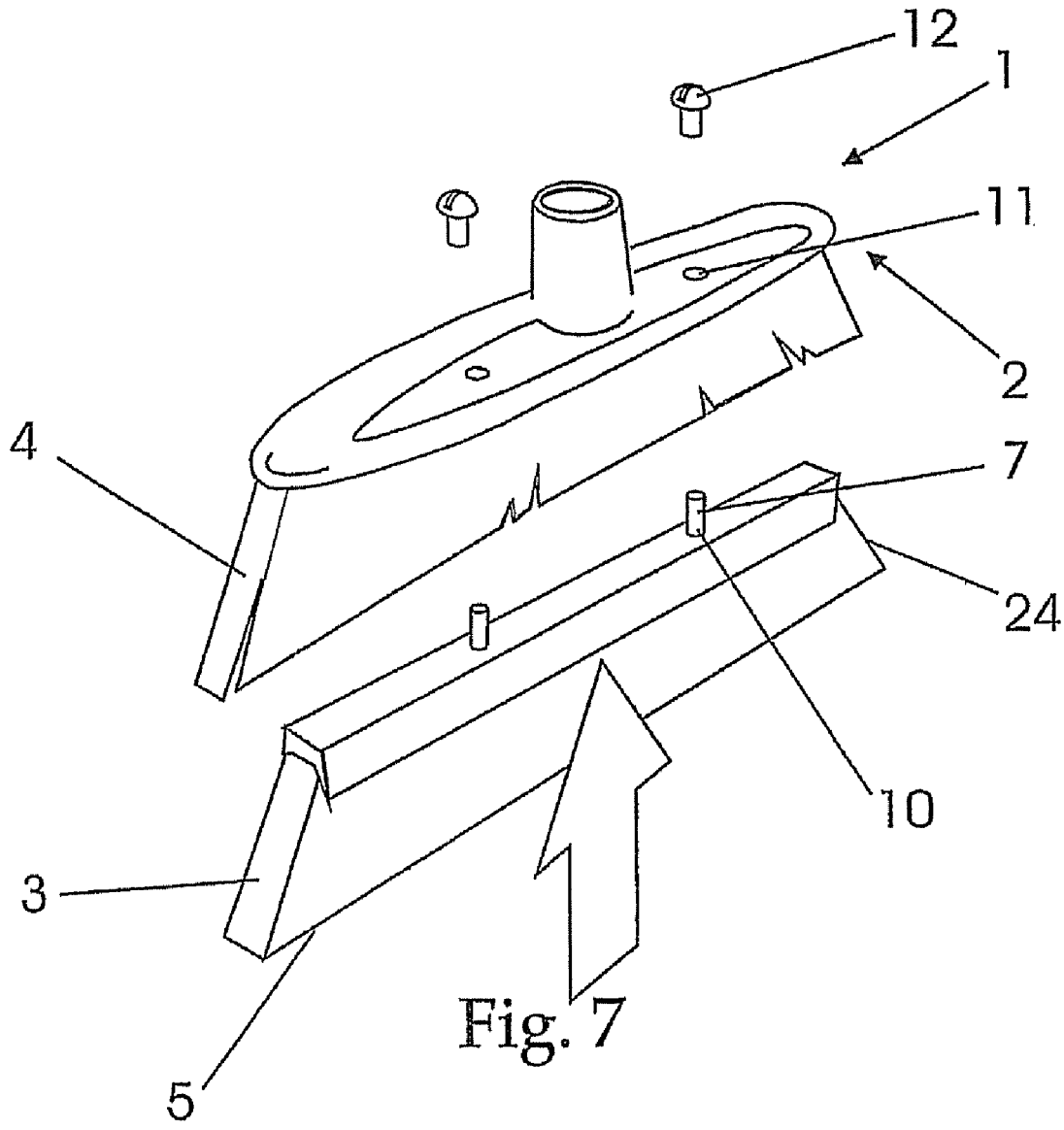
FIG. 7 a broom body with threaded bolt as fastening means.

FIG. 7 shows a broom body 1, in which the fastening means 7 is formed by a headless pin 10; in this embodiment two headless pins 10 are provided. The headless pin 10 can be engaged in an opening 11 of the broom body 1 and fixed by means of a screw 12, which can be mounted on the upper side of the broom body 1.

Figure 8:
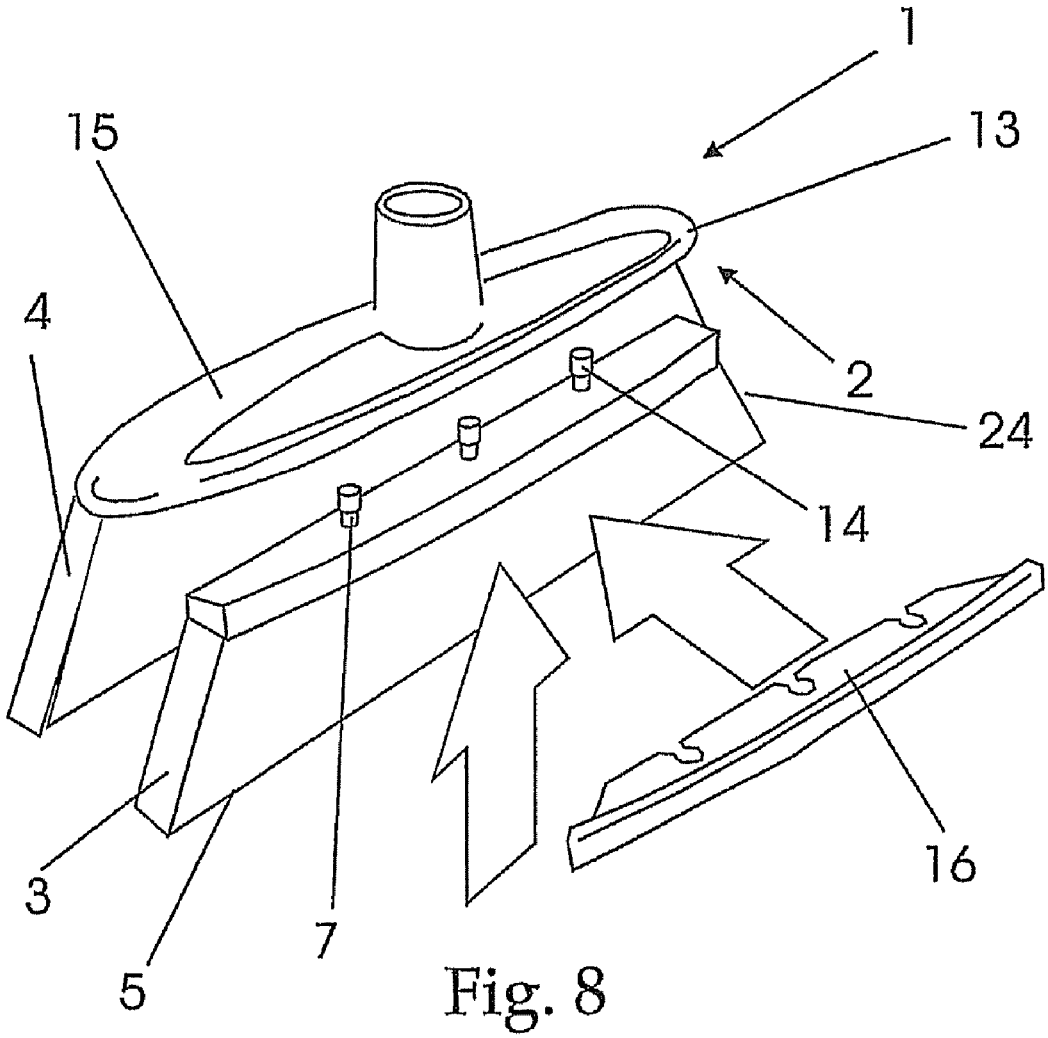
FIG. 8 a broom body with rods as fastening means.

FIG. 8 shows a broom body 1, in which the fastening means 7 is formed by a pin 14 provided with bulges 13. The pin 14 can be engaged in a recess 30 of the broom body 1. For fixation of the foam material body 5, the broom body 1 presents a longitudinal slit 15, into which a locking element 16 can be inserted. The locking element 16 can be engaged into the undercut formed by the bulge 13.

Figure 9:
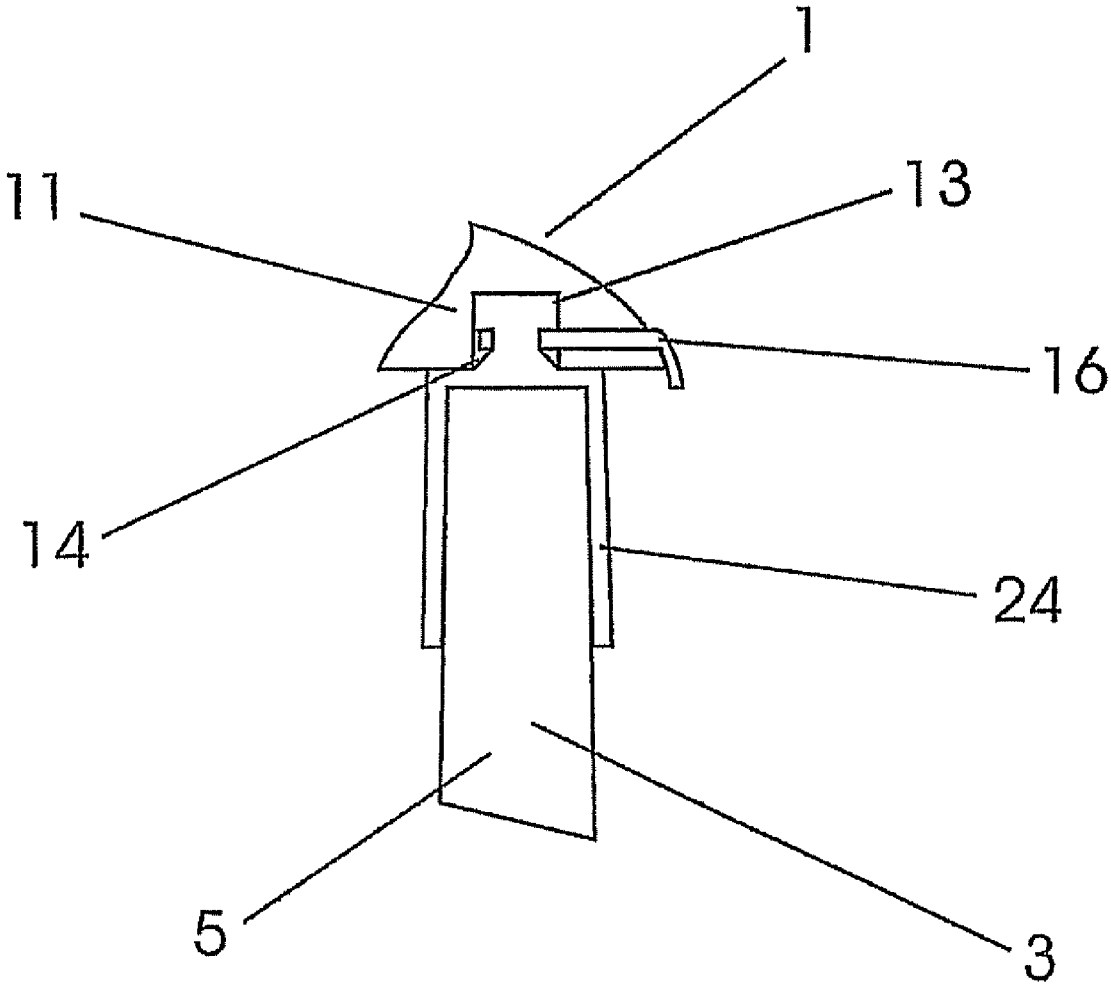
FIG. 9 the broom body according to FIG. 8 in cross section.

FIG. 9 shows the broom body according to FIG. 8 in cross section.

Figure 10:
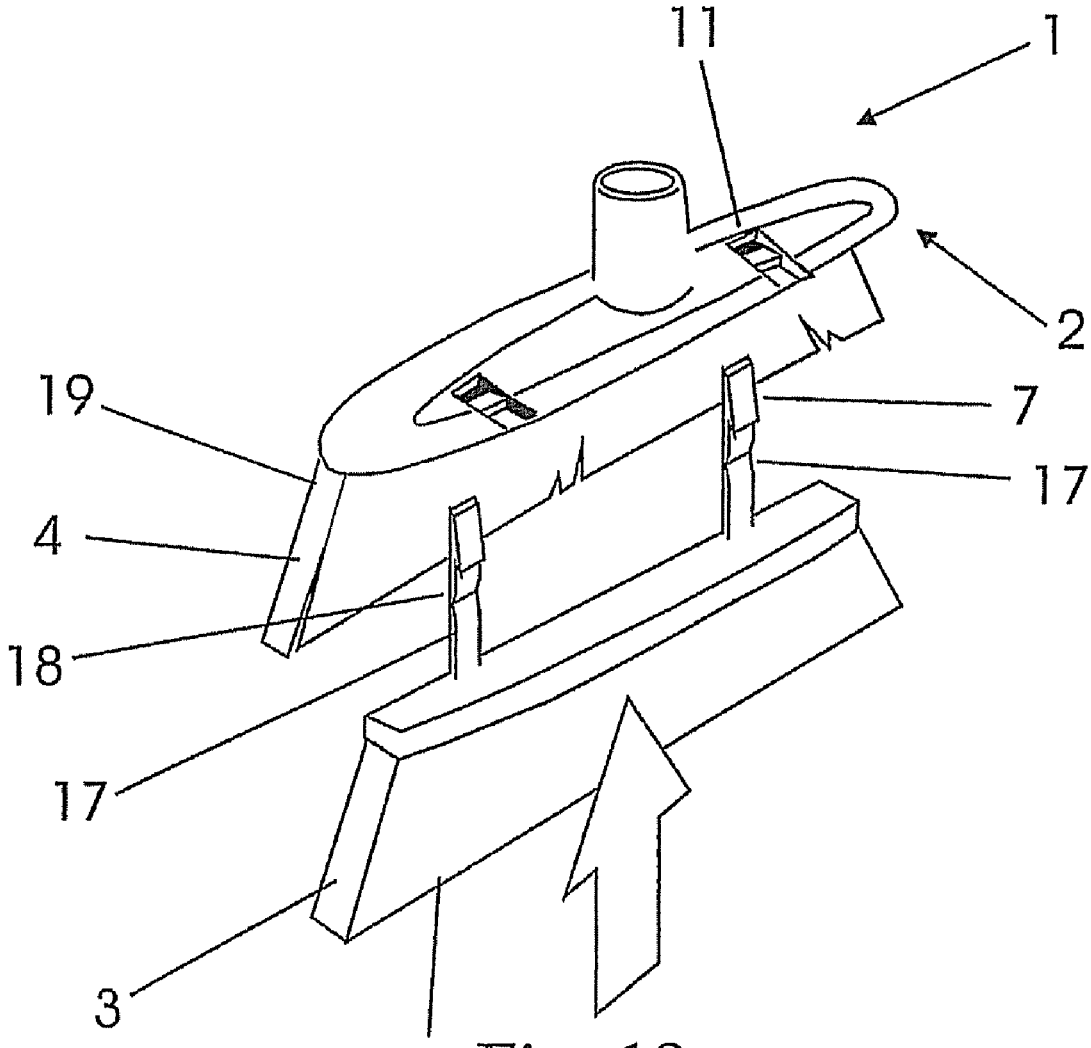
FIG. 10 a broom body with straps as fastening means.

FIG. 10 shows a broom body 1, in which the fastening means 7 is formed by a strap 17, which can be inserted through an opening 11 of the broom body 1. The strap 17 presents a film hinge 18 and a snap hinge closure element 19. For the fixation of the foam material body 5, the strap 17 is bent over after it has been inserted through the opening 11, and it is engaged by means of the snap hinge closure element 19.

Figure 11:
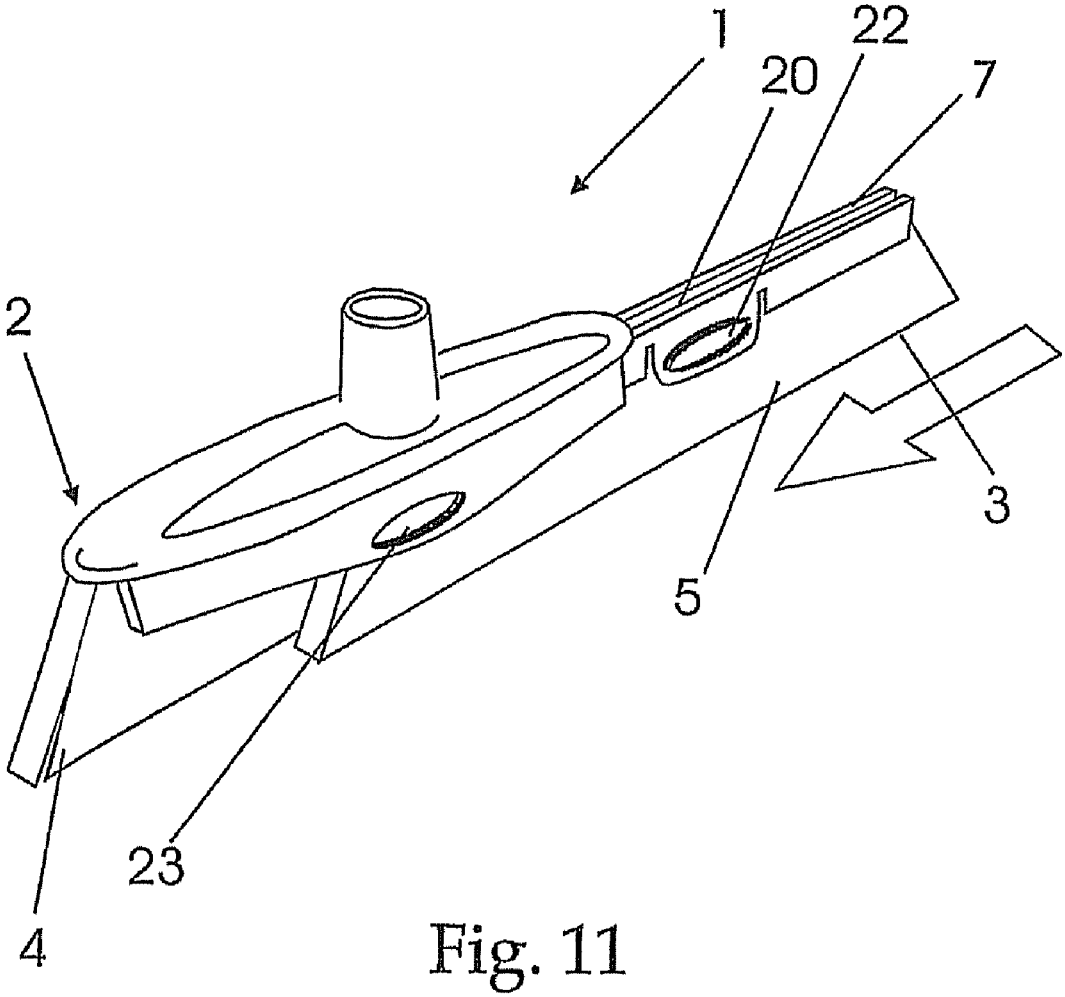
FIG. 11 a broom body with a snap hinge closure element as fastening means.

FIG. 11 shows a broom body 1, in which the fastening means 7 is formed by a rectangular profile 20 as well as by a snap hinge closure element 22. The rectangular profile 20 can be engaged in a correspondingly shaped matching profile 21 of the broom body 1. The primary function of the profiles 20, 21 is guidance. For the fastening of the foam material body 5, the snap hinge closure element 22 engages into a recess 23 of the broom body 1.

Figure 12:
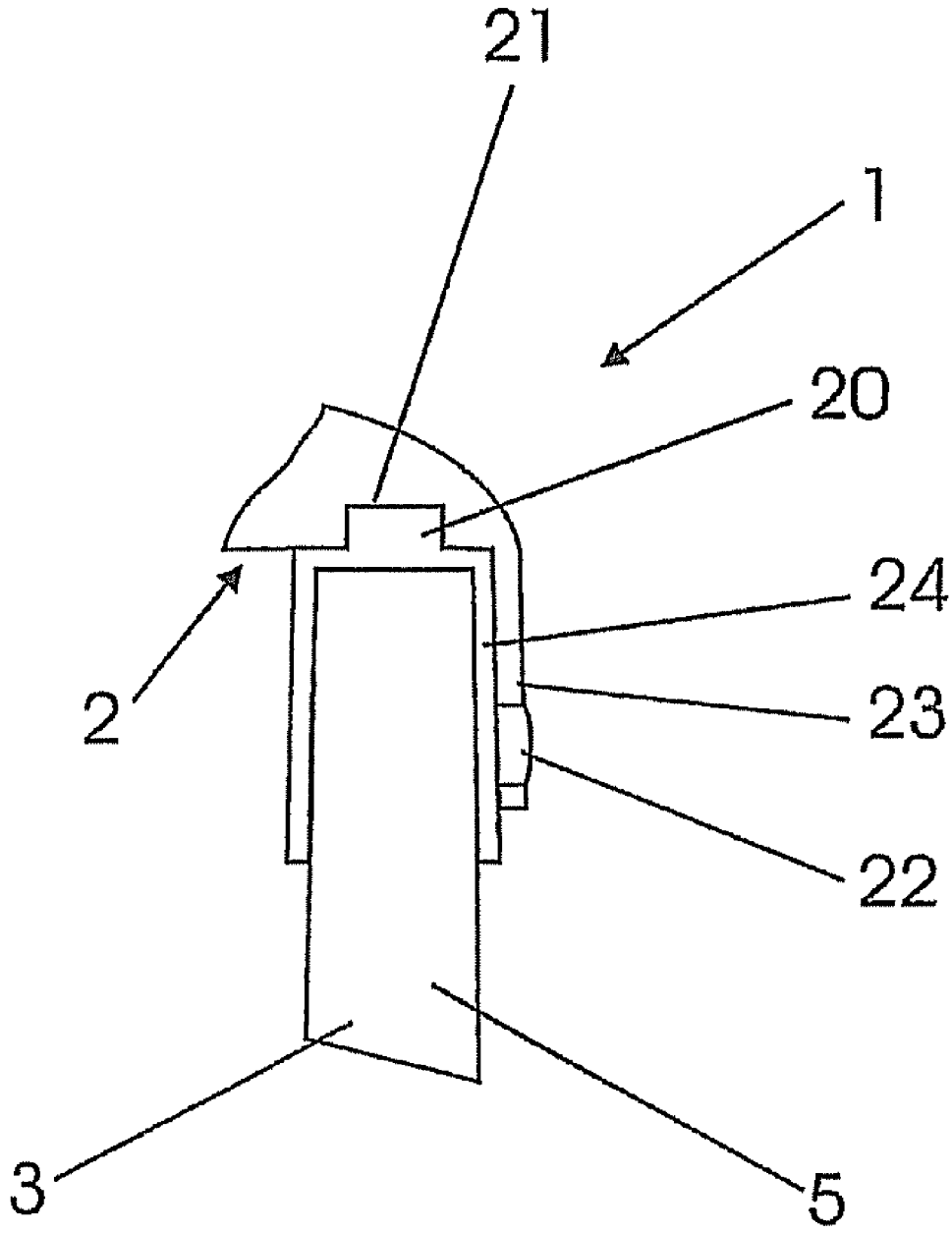
FIG. 12 the broom body according to FIG. 11 in cross section.

FIG. 12 shows the broom body according to FIG. 11 in cross section.

The invention claimed is:

1. A broom body comprising at least first and second cleaning bodies made of different materials, where the first cleaning body comprises a foam material, and a fastening mechanism for fastening the first cleaning body to the broom body including a dovetail pin which can be introduced into a socket, wherein the socket includes first partial sections with a corresponding dovetail configuration and second partial sections without a dovetail configuration at least some of which are interposed between the first partial sections.

2. A broom body according to claim 1, wherein the first cleaning body includes a carrier body on which the dovetail pin is arranged, the carrier body at least partially enclosing a plurality of sides of the first cleaning body comprising two parts which are joined.

3. A broom body according to claim 2, wherein a part presents projections, which can be introduced into recesses of the first cleaning body.

4. A broom body according to claim 2, wherein at least one part presents tooth-shaped elevations.

5. A broom body according to claim 2 wherein both parts present tooth-shaped elevations, which are arranged so they engage each other.

* * * * *